US009073735B2

(12) United States Patent
Byrd

(10) Patent No.: US 9,073,735 B2
(45) Date of Patent: Jul. 7, 2015

(54) PORTABLE CRANE ASSEMBLY FOR USE WITH MARINE VESSELS

(75) Inventor: Kevin Samuel Byrd, Raleigh, NC (US)

(73) Assignee: Kevin Samuel Byrd, Raleigh, NC (US)

( * ) Notice: Subject to any disclaimer, the term of this patent is extended or adjusted under 35 U.S.C. 154(b) by 115 days.

(21) Appl. No.: 13/540,272

(22) Filed: Jul. 2, 2012

(65) Prior Publication Data

US 2014/0001138 A1 Jan. 2, 2014

(51) Int. Cl.

| | |
|---|---|
| ***B66C 23/48*** | (2006.01) |
| ***B63C 3/06*** | (2006.01) |
| ***B66C 23/84*** | (2006.01) |
| ***B66C 23/20*** | (2006.01) |

(52) U.S. Cl.

CPC . *B66C 23/48* (2013.01); *B63C 3/06* (2013.01); *B66C 23/203* (2013.01)

(58) Field of Classification Search

USPC ..... 212/180, 295, 296, 307, 245, 253; 254/324, 325, 332; 414/678, 137.7, 414/139.4, 139.8; 114/365, 373; 119/725

See application file for complete search history.

(56) References Cited

U.S. PATENT DOCUMENTS

| | | | | |
|---|---|---|---|---|
| 282,937 | A * | 8/1883 | Vaughan | 294/67.4 |
| 1,291,746 | A * | 1/1919 | Bradney et al. | 212/180 |
| 2,072,398 | A * | 3/1937 | Faulk | 254/329 |
| 2,292,353 | A * | 8/1942 | Ennis et al. | 212/176 |
| 2,875,753 | A * | 3/1959 | Sulmonetti | 602/34 |
| 3,519,154 | A * | 7/1970 | Riley | 414/462 |
| 3,836,024 | A * | 9/1974 | Mantino | 414/543 |
| 3,845,869 | A * | 11/1974 | Sowers et al. | 212/180 |
| 4,560,074 | A * | 12/1985 | Manning | 212/179 |
| 4,764,081 | A * | 8/1988 | Peterson | 414/678 |
| 5,020,463 | A * | 6/1991 | Franklin et al. | 114/230.17 |
| 5,108,251 | A * | 4/1992 | Lougheed et al. | 414/546 |
| 5,590,618 | A * | 1/1997 | Marshall | 114/343 |
| 6,027,103 | A * | 2/2000 | Painter | 254/332 |
| 6,983,856 | B1 * | 1/2006 | Burks | 212/179 |
| 7,536,965 | B2 * | 5/2009 | Johnson | 114/44 |
| 7,886,948 | B2 * | 2/2011 | Kerr | 224/519 |

* cited by examiner

*Primary Examiner* — Emmanuel M Marcelo
*Assistant Examiner* — Justin Stefanon
(74) *Attorney, Agent, or Firm* — NKK Patent Law, PLC

(57) ABSTRACT

A crane assembly for lifting marine vessels is provided. The assembly includes a sleeve having first and second clamps extending therefrom that are configured for engaging with a pylon of a dock and a boom pole slideably and rotatably received within the sleeve. A winch assembly is carried by the boom pole and including a winch and a cord. A crossbar is provided that has a main support that receives the cord and that has a pair of adjustable supports being carried along a length thereof that are adjustable to vary the space between the pair of adjustable supports. The adjustable supports are configured for engaging a support strap that is configured for passing beneath the marine vessel.

17 Claims, 4 Drawing Sheets

PORTABLE CRANE ASSEMBLY FOR USE WITH MARINE VESSELS

TECHNICAL FIELD

This disclosure is related to an apparatus for lifting and moving marine vessels, and, more particularly, towards a crane assembly for use in attaching to a pier or dock and lifting marine vessels from a water body. The crane assembly may be portable in nature.

BACKGROUND

Residential and commercial marine vessels are many times stored along a dock or pier that extends from the shoreline of a body of water. The vessels may be stored on a platform that is liftable by use of a cable and pulley assembly that provides for movement of the platform and vessel in and out of the water. However, this platform model may be undesirable because of associated cost and expense in building the platform. Additionally, the platform may not be aesthetically pleasing. Furthermore, the platform is many times permanent and therefore occupies valuable water space about the dock.

The platform may be important for elevating the marine vessel out of the body of water, particularly in the winter and off-season months in order to reduce wear associated with being exposed to the winter and off-season elements. For vessel owners without such a platform, the vessel may have to be removed from the water on a trailer and taken elsewhere for storage. This represents a time intensive and cumbersome process.

A need therefore exists for a solution that addresses these disadvantages.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is a crane assembly for lifting marine vessels. The crane assembly includes a sleeve having first and second clamps extending therefrom that are configured for engaging with a pylon of a dock, a boom pole slideably and rotatably received within the sleeve, and a winch assembly carried by the boom pole and configured for engaging with the marine vessel.

According to one or more embodiments, the sleeve further includes at least one bearing in which the outer race is engaged with an inner surface of the sleeve and the inner race is configured for engaging with the boom pole.

According to one or more embodiments, the at least one bearing is positioned inline with one of the first and second clamps.

According to one or more embodiments, the crane assembly includes ball bearings in a bottom portion of the sleeve.

According to one or more embodiments, the crane assembly includes an o-ring at a top portion of the sleeve for maintaining a moisture impervious enclosure within the sleeve.

According to one or more embodiments, the winch assembly includes a winch and a cable.

According to one or more embodiments, the boom pole further includes a roller assembly on an end thereof for providing translation movement to the cord of the winch assembly.

According to one or more embodiments, the winch is hand or electric operated.

According to one or more embodiments, the crane assembly includes a crossbar configured for receiving a cable of the winch assembly and for lifting a marine vessel.

According to one or more embodiments, the crossbar has a pair of adjustable supports carried along a length thereof that are adjustable to vary the space between the pair of adjustable supports. The adjustable supports are configured for engaging a cable for lifting the marine vessel.

According to one or more embodiments, a crane assembly for lifting marine vessels is provided. The crane assembly includes a sleeve having first and second clamps extending therefrom that are configured for engaging with a pylon of a dock, a boom pole slideably and rotatably received within the sleeve, a winch assembly carried by the boom pole and including a winch and a cord, and a crossbar that has a main support that receives the cord and that has a pair of adjustable supports being carried along a length thereof that are adjustable to vary the space between the pair of adjustable supports. The adjustable supports are configured for engaging a support strap that is configured for passing beneath the marine vessel.

According to one or more embodiments, a wheeled assembly to which the sleeve is configured to be carried by is provided for transporting the crane assembly.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed subject matter is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Figure 1:
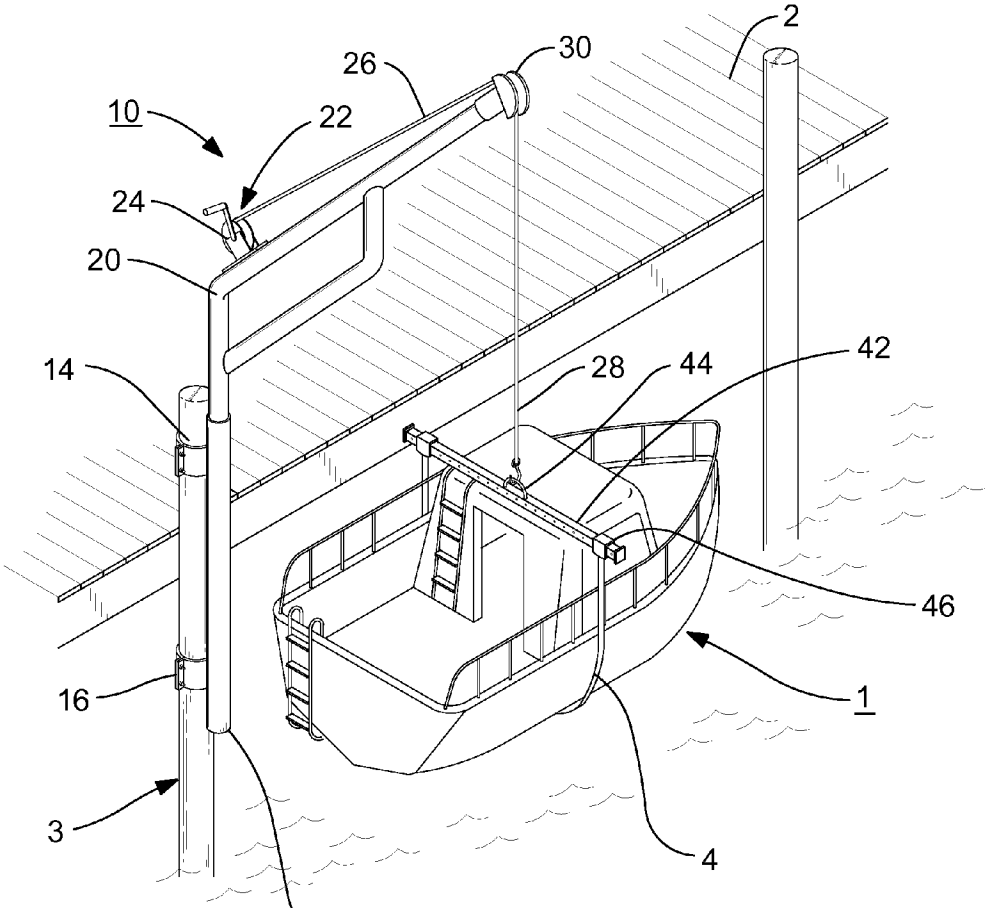
FIG. 1 illustrates a perspective view of a portable crane assembly positioned about a dock and being used to lift a marine vessel according to one or more embodiments disclosed herein.

FIG. 1 illustrates a crane assembly for lifting marine vessels, with the crane assembly being generally designated 10 and the marine vessel being generally designated 1. The crane assembly 10 generally includes a sleeve 12. The sleeve 12 may be cylindrically shaped as illustrated, or may be any appropriately configured shape. The sleeve 12 may further include a first clamp 14 and a second clamp 16. The first clamp 14 and second clamp 16 may extend from the sleeve 12 and may be configured for selectively engaging with a pylon 3 of a dock 2.

The crane assembly 10 may further include a boom pole 20. The boom pole 20 may be configured in the shape illustrated in FIG. 1 or may take on any appropriate configuration. The boom pole 20 is configured for being slideably and rotatably received within the sleeve 12. In this manner, the boom pole 20 can be rotated about the sleeve 12. In one or more embodiments, the boom pole 20 may be rotatable in a complete 360 degrees of rotation about sleeve 12. The boom pole 20 may also be selectively received within sleeve 12. In this manner, boom pole 20 may be removed from sleeve 12. This may be advantageous because, for example, boom poles having different shapes and configurations could be replaced within the crane assembly 10.

The crane assembly 10 may further include a winch assembly 22. The winch assembly 22 may be positioned on the boom pole 20 as illustrated, though the winch assembly 22 could be positioned elsewhere according to one or more embodiments.

Figure 2:
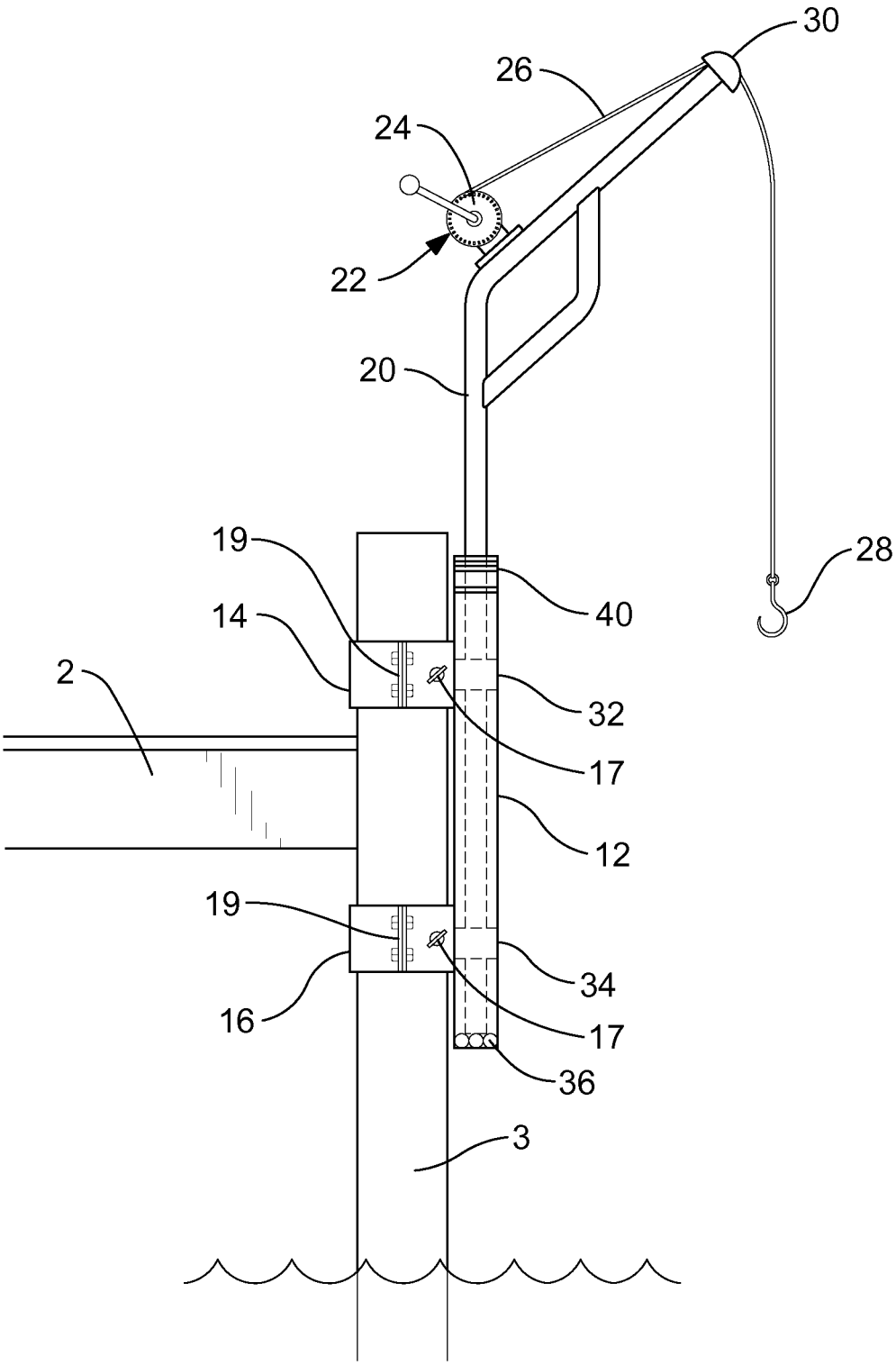
FIG. 2 illustrates a side view of a portable crane assembly positioned about a dock according to one or more embodiments disclosed herein.

As illustrated more closely in FIG. 2, the winch assembly 22 may include a winch 24 and a cable 26. As used herein, cable 26 may refer to a braided cable, a metal cable, a metallic or textile-based strap, or any other material capable of being received within the winch 24. Winch 24 may be a hand-operated winch as illustrated, thereby requiring the operator to apply manual forces to operate the winch. Alternatively, winch 24 may be an electric, pneumatic, or otherwise externally powered winch. The boom pole 20 may further include a roller assembly or guide 30 on an end thereof for providing translation movement and guidance to the cable 26 of the winch assembly 22. A hook 28 may be provided on the end of cable 26 for attaching the cable 26 to an object. Hook 28 may also be a clip or other fastener according to one or more embodiments.

The sleeve 12 may include a first bearing 32 positioned at an upwardly medial portion within the sleeve 12. The sleeve 12 may also include a second bearing 34 positioned at a downwardly medial portion within the sleeve 12. The boom pole 20 is received within bearings 32 and 34. In this manner, when using roller bearings, the inner race of each of bearings 32, 34 is engaged with the boom pole 20 and the outer race of each of bearings 32, 34 is engaged with the sleeve 12. The races of each bearing 32, 34 may be secured to the sleeve 12 by use of a threaded fastener, detent, press fit, or any other suitable manner. Bearings 32 and 34 may be roller bearings, ceramic bearings, bushings, or any other structure capable of providing rotational movement of the boom pole 20 relative to sleeve 12. The crane assembly 10 may further include additional bearings as needed. Additionally, in one or more embodiments, crane assembly 10 may not use any bearings such that the outer diameter of the portion of boom pole 20 received within sleeve 12 is about the same as the inner diameter of sleeve 12.

The first bearing 32 may generally aligned with the first clamp 14. Similarly, the second bearing 34 may be generally aligned with the second clamp 16. In this manner, torsional and shear forces applied to the crane assembly, particularly those about bearings 32, 34 and clamps 14, 16 are supported by the inline arrangement of the first bearing 32 about the first clamp 14 and the second bearing 34 about the second clamp 16.

Ball bearings 36 may be further provided in a bottom portion of the sleeve 12. The ball bearings 36 may be for providing support to the boom pole 20 when received within sleeve 12 and further to reduce frictional and other forces upon rotation of the boom pole 20 about sleeve 12. A seal 40 may additionally be provided about a top portion of the sleeve 12 for maintaining a moisture impervious enclosure within the sleeve 12. Seal 40 may be a gasket, o-ring, or similar structure.

Figure 3:
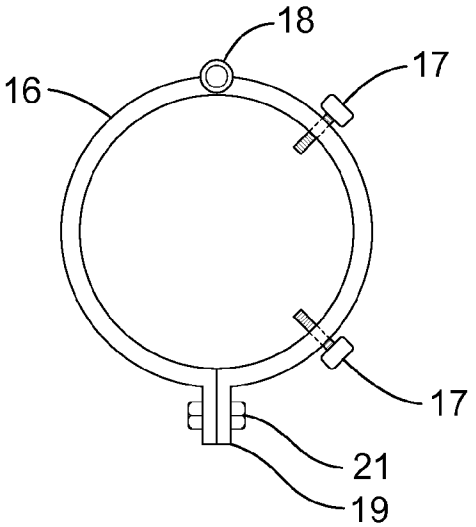
FIG. 3 illustrates a top view of a clamp assembly for use in engaging the portable crane assembly to the dock as illustrated in FIG. 1 according to one or more embodiments disclosed herein.

A top view of the second clamp 16 is illustrated in FIG. 3. As illustrated, the second clamp 16 may include fasteners 17 that extend inward-radially. The fasteners 17 are configured to extend into the opening of the clamp 16 and into engagement with pylon 3. This further secures clamp 16, and thus crane assembly 10, into engagement with the pylon 3. A hinged joint 18 may be provided for allowing swing movement of separated halves of the second clamp 16. In this manner, the clamp 16 may be opened to receive an object such as pylon 3, and then closed by rotation of the clamp 16 about hinge 18 until lock surfaces 19 are in abutting contact. Lock surfaces 19 are secured into engagement by the use of fastener 21. The first clamp 16 may include the same or similar features, or may be a solid cylindrical, un-separable clamp or ring that slides over pylon 3.

Figure 4:
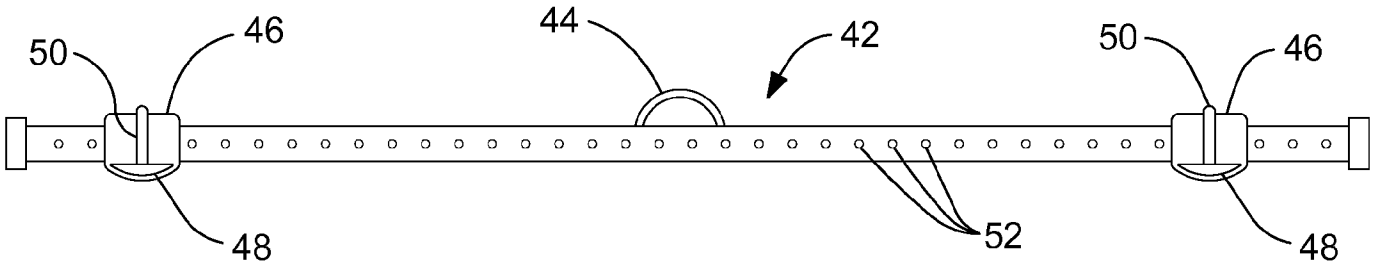
FIG. 4 illustrates a crossbar member for use with the portable crane assembly to lift a marine vessel in a manner similar to that which is illustrated in FIG. 1 according to one or more embodiments disclosed herein.

As illustrated in FIG. 4, a crossbar 42 may be provided for use with crane assembly 10. The crossbar 42 may define a bracket 44 that is configured for receiving the hook 28 of cable 26 of the winch assembly 22. The crossbar 42 may further define adjustable support brackets 46 on opposing ends thereof. The support brackets 46 may define openings 48 that are configured for receiving end portions of a support brace cable 4 configured for wrapping beneath the vessel 1 and into engagement therewith. The support brackets 46 may further define a handle assembly 50 that is operably coupled with a shaft that extends into a respective opening 52 defined in the crossbar 42. In this manner, the operator may select a desired positioning of each support bracket 46 by rotation of the handle assembly 50 to ingress and egress the shaft in and out of the opening 52 until the opening corresponding to the desired spacing is reached. In one or more embodiments, crossbar 42 may also be employed beneath the vessel 1.

Figure 5B:
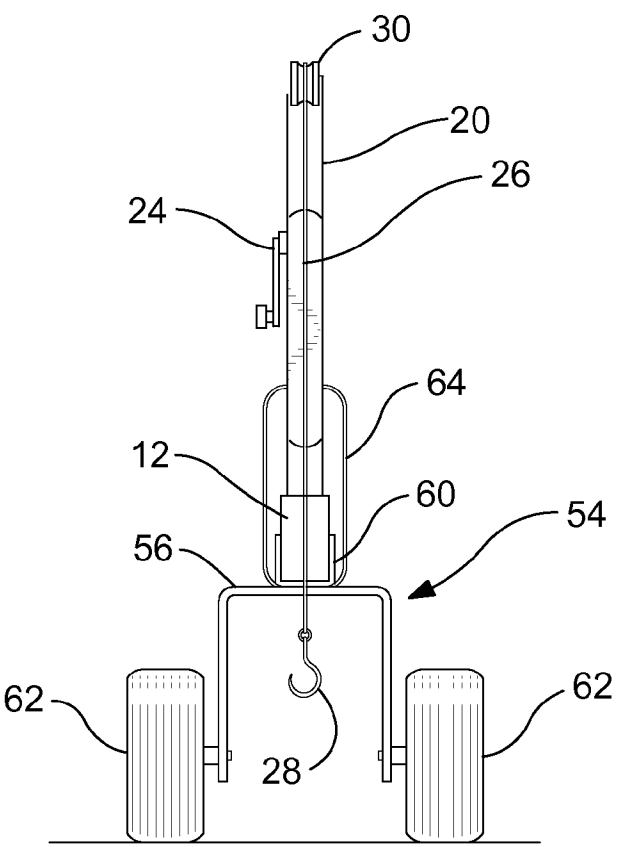
FIG. 5B is a front view of a crane assembly being carried by a transport assembly for transporting the crane assembly to a desired location according to one or more embodiments disclosed herein.
Figure 5A:
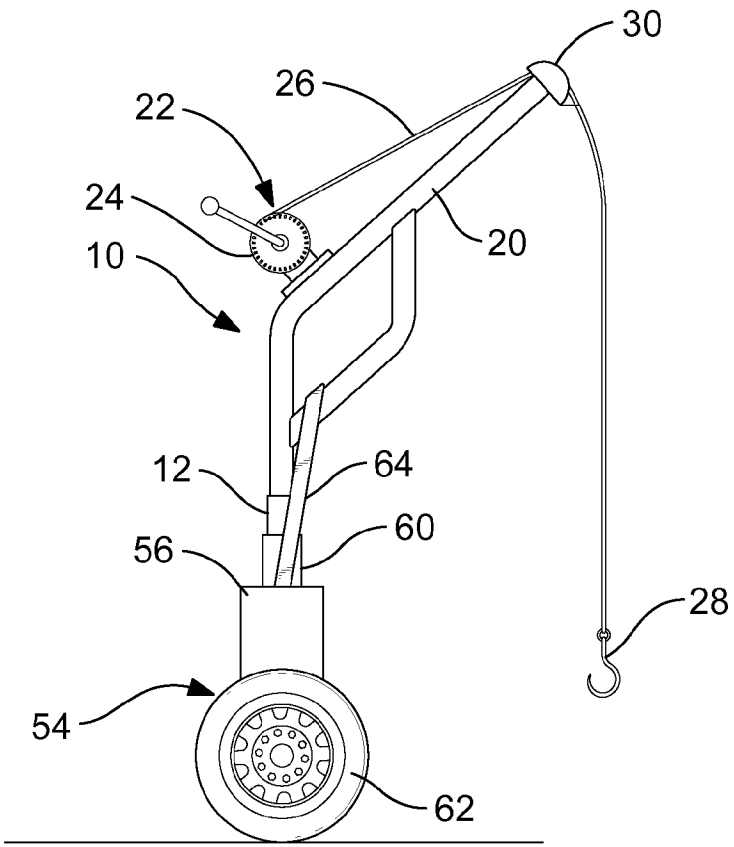
FIG. 5A is a side view of a crane assembly being carried by a transport assembly for transporting the crane assembly to a desired location according to one or more embodiments disclosed herein.

As illustrated in FIG. 5A and FIG. 5B, the crane assembly 10 may be configured for transport about a transport assembly 54. The transport assembly 54 may include a main support 56 to which a bracket 60 is carried on and configured for engaging with the sleeve 12 of the crane assembly 10. A wheeled assembly 62 may be provided for allowing transport of the transport assembly 54. A strap 64 may be configured for extending from about the support 56 to the boom pole 20 and may be provided with a ratcheting mechanism for securing the crane assembly 10 to the transport assembly 54. In this manner, the crane assembly 10 may be transported from a storage facility to a dock for use.

Attachment of the crane assembly 10 is accomplished by sliding the first clamp 14 over the pylon 3. The second clamp 16 is then opened so that it can receive pylon 3 therein. Second clamp 16 is then closed. Handle assemblies 17 are then turned until the associated shaft is in engagement with pylon 3. The boom pole 20 is then positioned by rotating about sleeve 12 until in a desired position or orientation. The operator then engages cable 26 with the vessel 1 or crossbar 42 and operates winch assembly 22 until the vessel is in a desired position.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A crane assembly for lifting marine vessels, comprising:

a cylindrical sleeve;

a first clamp and a second clamp, each extending from the sleeve and configured to engage a pylon of a dock;

a boom pole slideably and rotatably received within the sleeve;

a winch assembly carried by the boom pole and having a cable extending therefrom for engaging with the marine vessel;

wherein at least one of the first clamp and second clamp comprises a first semicircular portion and a second semicircular portion together defining a circular perimeter around a longitudinal axis along which a pylon of a dock is to be received, and wherein the first semicircular portion and the second semicircular portion are coupled together by a hinge pin at a first position along the circular perimeter and a fastener at a second position along the circular perimeter different than the first position;

a crossbar configured for receiving the cable of the winch assembly, the cross bar comprising:

a support coupled to the cable and extending from a medial portion of the crossbar;

a first linear portion extending in a first direction from the support and a second linear portion extending co-linearly in a second direction opposite the first direction, wherein multiple first openings are defined in linear arrangement along the first portion, and multiple second openings are defined in linear arrangement along the second portion;

a first bracket slideably mounted on the first portion of the crossbar, the first bracket having a first shaft and a first handle operably coupled to the first shaft to insert the first shaft into any one of the first openings;

a second bracket slideably mounted on the second portion of the crossbar, the second bracket having a second shaft and a second handle operably coupled to the second shaft to insert the second shaft into any one of the second openings; and a strap having a first portion connected to the first bracket and a second portion connected to the second bracket, the strap extending from the first bracket to the second bracket and configured for being received beneath the marine vessel, the strap being in a same plane as a vertical plane extending from the crossbar.

2. The crane assembly of claim 1, wherein the sleeve further includes at least one bearing assembly having an outer race engaged with an inner surface of the sleeve and an inner race configured for engaging with the boom pole.

3. The crane assembly of claim 2, wherein the at least one bearing assembly is positioned within the sleeve around the longitudinal axis at essentially a same position along the longitudinal axis as either of the first and second clamps.

4. The crane assembly of claim 3, further including ball bearings in a bottom portion of the sleeve.

5. The crane assembly of claim 3, further including an o-ring at a top portion of the sleeve for maintaining a moisture impervious enclosure within the sleeve.

6. The crane assembly of claim 1, wherein the winch assembly includes a winch and a cable.

7. The crane assembly of claim 6, wherein the boom pole further includes a roller assembly on an end thereof for providing translation movement to the cable of the winch assembly.

8. The crane assembly of claim 6, wherein the winch is hand or electric operated.

9. A crane assembly for lifting marine vessels, comprising:

a sleeve having a first clamp and a second clamp each extending therefrom that are configured for engaging with a pylon of a dock;

a boom pole slideably and rotatably received within the sleeve;

a winch assembly carried by the boom pole and including a winch and a cord;

a support coupled to the cord;

a straight crossbar connected to the support at a medial portion of the straight crossbar, the straight crossbar having a first linear portion extending in a first direction from the support and a second linear portion extending co-linearly in a second direction from the support opposite the first direction, wherein multiple first openings are defined in the straight bar in a linear arrangement along the first portion, and multiple second openings are defined in the straight bar in a linear arrangement along the second portion;

a first bracket slideably mounted on the first portion of the straight crossbar, the first bracket having a first shaft and a first handle operably coupled to the first shaft to insert the first shaft into any one of the first openings;

a second bracket slideably mounted on the second portion of the straight crossbar, the second bracket having a second shaft and a second handle operably coupled to the second shaft to insert the second shaft into any one of the second openings; and a strap having a first portion connected to the first bracket and a second portion connected to the second bracket, the strap extending from the first bracket to the second bracket and configured for being received beneath the marine vessel, wherein the strap is defined in a same plan as a vertical plane extending from the crossbar.

10. The crane assembly of claim 9, wherein the sleeve further includes at least one bearing having an outer race engaged with an inner surface of the sleeve and an inner race configured for engaging with the boom pole.

11. The crane assembly of claim 10, wherein the at least one bearing is positioned within the sleeve at essentially a same position along the sleeve as either of the first and second clamps.

12. The crane assembly of claim 11, further including ball bearings in a bottom portion of the sleeve.

13. The crane assembly of claim 11, further including an o-ring at a top portion of the sleeve for maintaining a moisture impervious enclosure within the sleeve.

14. The crane assembly of claim 13, wherein the boom pole further includes a roller assembly on an end thereof for providing translation movement to the cord of the winch assembly.

15. The crane assembly of claim 13, wherein the winch is hand or electric operated.

16. The crane assembly of claim 9, further including a wheeled assembly to which the sleeve is configured to be carried by.

17. The crane assembly of claim 9, wherein the second clamp defines a hinged joint on one portion thereof and a split joint about another portion thereof such that the second clamp can be opened to receive the pylon and closed to engage the pylon.

* * * * *